US005958328A

United States Patent [19]

Seok et al.

[11] Patent Number: 5,958,328

[45] Date of Patent: Sep. 28, 1999

[54] PROCESS OF MAKING LOESS-CONTAINING FIBER

[75] Inventors: Mi-Soo Seok, Shinnea Doosan Apartment 521-Dong 205-Ho, Mook-dong 20, Choongnang-gu, Seoul 131-140; U-Hyon Paek, Gyeong Nam, both of Rep. of Korea

[73] Assignee: Mi-Soo Seok, Seoul, Rep. of Korea

[21] Appl. No.: 09/049,241

[22] Filed: Mar. 27, 1998

[30] Foreign Application Priority Data

Apr. 2, 1997 [KR] Rep. of Korea ..... 97-12093
Apr. 9, 1997 [KR] Rep. of Korea ..... 97-12986

[51] Int. Cl.[6] ..... D01D 10/02; D01F 1/10

[52] U.S. Cl. ..... 264/678; 264/140; 264/211; 264/679

[58] Field of Search ..... 264/140, 211, 264/639, 678, 679

[56] References Cited

U.S. PATENT DOCUMENTS 5,221,289 6/1993 Miyamatsu et al. .

*Primary Examiner*—Leo B. Tentoni
*Attorney, Agent, or Firm*—Merchant & Gould P.C.

[57] ABSTRACT

Provided with a loess-containing fiber and its manufacturing method wherein the fiber contains loess that generates far-infrared rays and has antibiotic and disinfectant properties, the method including the steps of melting a polymer to form a melt polymer, firing loess in a firing furnace, grinding the fired loess into particles having a specified size by means of a mill, and admixing the powder of the ground loess with the melt polymer in a mixer.

5 Claims, No Drawings

PROCESS OF MAKING LOESS-CONTAINING FIBER

BACKGROUND OF THE INVENTION

1. Field of the Invention

The present invention relates to a loess-containing fiber and its manufacturing method, wherein the fiber contains minerals generating far-infrared rays and ions in addition to loess.

2. Discussion of Related Art

Loess which is composed of silica, alumina, ferric oxide, titan dioxide, manganese oxide, lime and magnesium oxide contains various enzymes such as catalase, diphenol oxidase, saccharase, protease and so forth. Such a loess gives off far-infrared rays that helps blood-circulation in the human body, and is antibiotic and disinfectant such that it has an efficacy on the treatment of all sorts of diseases such as gastrointestinal disease, dysentery, diarrhea, tumor, contusion or the like, as well as being helpful in skin care and ageing prevention. It is also well-known that lots of ions are generated from elvan, amphibole, mica (biotite, silk mica and illite mica), greenstone, white jade, ruby, jadeite, silica agate and obsidian, which leads to the activation of bio-functions in the body.

SUMMARY OF THE INVENTION

Accordingly, the present invention is directed to a loess-containing fiber and its manufacturing method that substantially obviates one or more of the problems due to limitations and disadvantages of the related art.

An object of the present invention is to provide a loess-containing fiber and its manufacturing method, wherein a fiber formed by mixing loess and various minerals with a melt polymer is admixed with other fibers such as cotton, wool and silk, and the thus obtained fiber is used in the manufacture of all sorts of textiles, garments, wadding, yarn, bedding and health products, generating far-infrared rays that enhances heat insulation as well as ions for activating the bio-functions in human body, and giving antibiotic and disinfectant properties to remove the smell of sweat.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof.

A loess-containing fiber of the present invention includes 95 to 100 wt. % melt polymer with liquid quality, and 0 to 5 wt. % loess powder irradiates far-infrared rays.

Further, a method of manufacturing the loess-containing fiber according to the present invention includes the steps of: a) forming a melt polymer by melting a polymer in a melting furnace and maintaining the melt polymer in a liquid state; b) firing loess in a firing furnace in order to mix the loess with the melt polymer; c) grinding the fired loess into particles having a specified size by means of a mill; d) admixing the powder of the ground loess with the melt polymer in a mixer; and e) extrusive-spinning the mixture of the loess and the melt polymer to produce a fiber.

It is to be understood that both the foregoing general description and the following detailed description are exemplary and explanatory and are intended to provide further explanation of the invention as claimed.

DETAILED DESCRIPTION OF PREFERRED EMBODIMENT

Reference will now be made in detail to a loess-containing fiber and its manufacturing method according to the preferred embodiments of the present invention.

(Embodiment 1)

A polymer is first fused in a melting furnace to form a melt polymer and then heated to an appropriate temperature in order to be maintained in the liquid state.

Preferably, the polymer is acryl, plastic, nylon or polyester and fused at a temperature above about 120° C., wherein the melting temperature of the polymer varies depending on the property of the polymer.

Loess is fired at a firing temperature of about 1200° C.

The fired loess is ground into powder particles having a specified size by means of a mill.

The particle size of the loess powder is in the range between 800 and 12500 mesh.

The loess powder is then admixed with the melt polymer in a mixer to obtain a mixture of the melt polymer and the loess powder. This composition contains less than 5 wt. % loess powder and greater than 95 wt. % melt polymer.

The melt polymer admixed with the loess powder is subjected to an extrusive spinning in an extruder, producing a fiber.

In the extrusive spinning step, the length of fiber obtained can be regulated long or short as the manufacturer desires.

The resulting fiber is mixed with cotton, wool, silk or chemical fiber to produce a synthetic fiber. This synthetic fiber is employed in the manufacture of all sorts of textiles, garments, wadding, yarn, bedding and health products such that far-infrared rays generated from the fiber enhances heat insulation. Further, such a fiber has antibiotic and disinfectant properties sufficient to remove the smell of sweat.

(Embodiment 2)

A polymer is first fused in a melting furnace to form a melt polymer and then heated to an appropriate temperature in order to be maintained in the liquid state.

Preferably, the polymer is acryl, plastic, nylon or polyester and melt in the 120 to 285° C. range of temperature, wherein the melting temperature of the polymer varies depending on the property of the polymer.

Loess is fired at a firing temperature of about 1200° C. before loess, and elvan is mixed with the melt polymer.

The fired loess and elvan are ground into powder particles having a specified size by means of a mill.

The particle size of the loess powder is in the range between 800 and 12500 mesh.

The powder of loess and elvan is admixed with the melt polymer in a mixer to obtain a mixture of melt polymer and loess and elvan powder. This composition contains less than 5 wt. % loess and elvan powder and greater than 95 wt. % melt polymer.

The melt polymer admixed with the loess and elvan powder is then subjected to an extrusive spinning in an extruder, producing a fiber.

In the extrusive spinning step, the length of fiber obtained can be regulated long or short as the manufacturer desires.

The resulting fiber is mixed with cotton, wool, silk or chemical fiber to produce a synthetic fiber. This synthetic fiber is employed in the manufacture of all sorts of textiles, garments, wadding, yarn, bedding and health products such that far-infrared rays generated from the fiber contained in the products enhances heat insulation. Also, such a fiber has antibiotic and disinfectant properties sufficient to remove the smell of sweat.

The powder of fired and ground amphibole may be mixed with the loess and elvan in the admixing step, thereby providing bones with energy as well as far-infrared rays originated from the fiber and generating ions that activate the bio-functions in the body.

Further, the same effect can be attained by mixing the powder of fired and ground mica such as biotite, silk mica and illite mica with loess and elvan in the admixing step.

On the other hand, at least one mineral selected from the group consisting of greenstone, white jade, ruby, jadeite, silica agate and obsidian is ground and mixed with loess in the admixing step, generating ions and far-infrared rays from the mineral. The mineral powder is then fired and mixed with the loess and elvan. This mixture is added to the melt polymer, which is then processed into a fiber in the extrusive spinning step.

Such as in the loess-containing fiber and its manufacturing method as described above, the fiber gives off far-infrared rays that helps blood-circulation in the human body, and is antibiotic and disinfectant such that it has an efficacy on the treatment of all sorts of diseases such as gastrointestinal disease, dysentery, diarrhea, tumor, contusion or the like. Further, the loess-containing fiber is mixed with cotton, wool, silk or chemical fiber in the manufacture of all sorts of textiles, garments, wadding, yarn, bedding and health products, so that far-infrared rays generated from the fiber enhances heat insulation. Additionally, the smell of sweat can be eliminated due to antibiotic and disinfectant properties of the loess contained in the fiber.

It will be apparent to those skilled in the art that various modifications and variations can be made in the loess-containing fiber and its manufacturing method of the present invention without departing from the spirit or scope of the invention. Thus, it is intended that the present invention cover the modifications and variations of this invention provided they come within the scope of the appended claims and their equivalents.

What is claimed is:

1. A method of manufacturing a loess-containing fiber, comprising the steps of:

a) forming a melt polymer by melting a polymer in a melting furnace and maintaining the melt polymer in a liquid state;

b) firing loess in a firing furnace in order to mix the loess with the melt polymer;

c) grinding the fired loess into particles having a specified size by means of a mill;

d) admixing the powder of the ground loess with the melt polymer in a mixer; and e) extrusive-spinning the mixture of the loess and the melt polymer to produce a fiber.

2. The method as defined in claim 1, wherein a powder of fired and ground elvan is admixed with the loess in step c).

3. The method as defined in claim 1, wherein a powder of fired and ground amphibole is admixed with the loess in step c).

4. The method as defined in claim 1, wherein a powder of fired and ground mica is admixed with the loess in step c).

5. The method as defined in claim 1, wherein at least one mineral selected from the group consisting of greenstone, white jade, ruby, jadeite, silica agate and obsidian is ground, mixed and fired to form powder, the powder being mixed with the loess in step c).

* * * * *